US005125350A

United States Patent [19]

Frye et al.

[11] Patent Number: 5,125,350

[45] Date of Patent: Jun. 30, 1992

[54] APPARATUS AND METHOD FOR ATTACHING REINFORCEMENT TO A FLEXIBLE SHEET

[75] Inventors: Ricky J. Frye, Miamisburg; Robert N. Landis, New Lebanon, both of Ohio

[73] Assignee: MIM Industries, Inc., Miamisburg, Ohio

[21] Appl. No.: 729,482

[22] Filed: Jul. 12, 1991

[51] Int. Cl.[5] ..... D05B 3/22; D05B 21/00

[52] U.S. Cl. ..... 112/113; 112/114; 112/121.12; 112/262.3; 112/265.1; 112/155

[58] Field of Search ..... 112/113, 114, 104, 121.12, 112/121.11, 265.1, 262.3, 303, 311, 155

[56] References Cited

U.S. PATENT DOCUMENTS

| | | | |
|---|---|---|---|
| 4,371,159 | 2/1983 | Doyen et al. | 112/121.12 X |
| 4,917,030 | 4/1990 | Bisson et al. | 112/121.12 |
| 4,967,675 | 11/1990 | Goldbeck et al. | 112/114 X |
| 4,989,525 | 2/1991 | Portilla | 112/155 X |
| 5,012,752 | 5/1991 | Murata et al. | 112/121.12 |

*Primary Examiner*—Peter Nerbun
*Attorney, Agent, or Firm*—Joseph G. Nauman

[57] ABSTRACT

A programmable sewing head including a work controlling clamping mechanism is automatically loaded with air bag material or the like, together with a reinforcement strategically placed thereon, for automatic attachment (by a predetermined stitching pattern) of the reinforcement to the bag material. A table having a loading station supports material orienting an aperture and the reinforcement, and extends to a transfer station at the sewing head. A locator aperture and a retractable locator head are in the table surface at the loading station for receiving the sheet and reinforcement. Placement of the reinforcement and the sheet over the locator pad aligns the reinforcement with respect to the hole in the sheet. A transfer pad, having a configuration corresponding to the locator pad is supported over the table surface, normally located near the loading station, and is movable into vertical alignment with the locator pad, for movement (a) along a vertical path extending through said locator pad, and also (b) for movement along the loading path to the sewing head. The transfer pad has a pilot portion constructed to be force fit through a reinforcement and the related hole in a flexible sheet, to displace the locator pad from the sheet and the reinforcement. Movement of the transfer pad along the table carries the parts into position for transfer into the clamping mechanism and sewing.

10 Claims, 16 Drawing Sheets

APPARATUS AND METHOD FOR ATTACHING REINFORCEMENT TO A FLEXIBLE SHEET

BACKGROUND OF THE INVENTION

This invention relates to an apparatus and method for making an attachment, such as an annular reinforcement. to a predetermined location on a flexible sheet, e.g. around the periphery of an aperture in the sheet.

Although the invention is applicable to a number of uses, a specific application of the invention concerns stitching, in a predetermined manner, a circular (annular) piece of reinforcing fabric around a vent hole in one of the major parts of a safety air bag. Those skilled in the art will recognize other uses, such as adding parts to the air bags, or more generally, to the addition of pieces which require precise placement onto flexible sheets of fabric or the like for other purposes.

Such air bag devices are known. They are actuated in case of an accident, usually in response to rapid deceleration of the vehicle to which they are fitted, so as to deploy in front of the head and upper torso of a driver or passenger in the vehicle. It is necessary that after deployment, the air bag release so as not to impede egress (or rescue efforts) for the person. To that end, the air bags are fitted with one or more vent openings which allow the inflation gas to escape from the bag at a predetermined rate. In some forms, the vent hole may be controlled by a flap valve or the like. Thus, the exact area of the aperture or vent opening is quite important, as is the fact that this vent size be maintained before and during use of the air bag, and that any attachment be precisely and securely fastened in place.

In air bag design, reinforcements are prescribed by material and vent size and width of the reinforcement, i.e. its overlap of the bag material around the vent aperture. Also, the manner of attachment, e.g. type, location, and number of stitches in a sewn attachment, are pre-ordained. With current and future efforts to fit air bags to many more vehicles, there is a need to automate, or at least partially automate, the fitting and attachment of these vent reinforcements, as well as other fabric attachments for the air bag and its major material. Thus, in this use alone there is a need for the present invention.

SUMMARY OF THE INVENTION

In accordance with this invention there is provided a programmable sewing head including a work clamp device having an opening greater than the aperture, into which the air bag material is loaded, together with the reinforcement strategically placed thereon, for automatic attachment (by a predetermined stitching pattern) of the reinforcement to the bag material. A loading station is provided for supporting the bag material (usually a sheet of rubber coated nylon cloth) and orienting the aperture therein which requires a reinforcement. The loading station includes a support table for the flexible sheet, having a surface extending beneath said sewing head and outwardly away therefrom, also defines a predetermined loading path along the table surface to a transfer station at the clamp of the sewing head.

A locator aperture is formed in the table surface at the loading station, such locator aperture preferably having a configuration corresponding to the aperture in the sheet. A locator device is mounted in the locator aperture and includes a retractable locator pad normally positioned above said surface and retractable into said surface. The locator pad in its ready position is arranged to extend through the aperture in the table surface, presenting a precise loading position for the aperture or vent hole in the flexible sheet, and the hole in the reinforcement. Thus placement of the reinforcement and the sheet over the locator pad aligns the reinforcement with respect to the aperture in the sheet at the loading station. This can be accomplished simply by the operator placing the vent hole in the sheet over the locator pad, and doing the same with the reinforcement either before or after placing the sheet in loading position. If the holes should happen to be of irregular shape, this action also can accomplish proper orientation of the reinforcement to the sheet.

A transfer pad, having a configuration corresponding to the locator pad so as to fit through the aligned apertures in a sheet and reinforcement, is supported over the table surface. The transfer pad is normally located at or near the loading station, and is movable into vertical alignment with the locator pad, for movement (a) along a vertical path extending through said locator pad, and also (b) for movement along the loading path to the sewing head. The transfer pad has a pilot portion constructed to be force fit through a reinforcement and the related aperture in a flexible sheet, aligned on the locator pad, and to displace the locator pad from the sheet and the reinforcement.

The pilot portion includes a peripheral groove dimensioned to engage with the aligned flexible sheet and reinforcement, and as a result of this displacing motion of the locator pad, it takes over control of the sheet and the reinforcement, holding the parts in alignment. A clamping ring is associated with the transfer pad and is separately movable so as to hold surrounding portions of the flexible sheet and the reinforcement against the table while the pilot portion enters the aligned aperture and annular reinforcement at the loading station. Preferably, the locator pad is then lifted slightly above the table surface. Subsequent movement of the transfer pad along the loading path carries those parts into position for transfer into the clamping mechanism of the sewing head. The sheet and reinforcement are transferred into that clamping mechanism, all the while maintaining alignment of those pieces; the transfer pad withdraws from the sheet and reinforcement, while its clamping ring holds them. The clamping ring then releases, and the transfer pad is returned to its ready position for accepting the next sheet/reinforcement combination, while the sewing head proceeds to stitch together the parts loaded therein. When the stitching operation is completed, the now combined sheet and reinforcement are released by the clamping mechanism, and removed for inspection and further processing.

The sewing head includes its own programmable controller, known in the art, which controls the operation of the head's stitching mechanism and the motion of its clamping mechanism, so as to complete the desired stitching pattern. The control means for moving the transfer pad, first to engage with a sheet and reinforcement at said loading station, then to raise the surrounding portion of the sheet and the reinforcement above the table surface and move those parts into the clamping mechanism of the clamping head, is provided by a further programmable controller, interacting with the controller for the sewing head, to coordinate movements of the loading mechanism with the sewing head mechanisms.

A discharge conveyor may be arranged adjacent the sewing head, to receive the sheet once stitching is completed and the clamping mechanism of the head is released. Such conveyor then acts to carry the sheet away to a desired location.

In a disclosed embodiment, two sewing heads and corresponding loading apparatus are provided as cooperating units, for working simultaneously on two different apertures in the same sheet. The discharge conveyor operates between the two units. Provisions are included for changing the spacing between the units to accommodate sheets of different size.

Therefore, the principal object of the invention is to provide a system for loading into a sewing head or the like, in aligned positions, a flexible sheet and a reinforcement member strategically placed in desired position on such sheet, where by the two may be joined as by stitching; to provide a method an apparatus for implementing the system; to provide such a system in which operator intervention is minimized and loading of parts is accomplished while an attaching (stitching) process is performed on previously loaded parts; to provide such a system with interactive programmable controls which can be adapted to a variety of parts to be joined; to provide such a system with a discharge that delivers the joined parts to an inspection location upon completion of the joining; particularly to provide such a system designed for precise application of reinforcements to parts of a safety air bag; and to provide such a system with multiple attaching devices (such as sewing heads) for simultaneously attaching multiple parts to a flexible sheet.

Other objects and advantages of the invention will be apparent from the following description, the accompanying drawings and the appended claims.

DESCRIPTION OF THE PREFERRED EMBODIMENT

Figure 1:
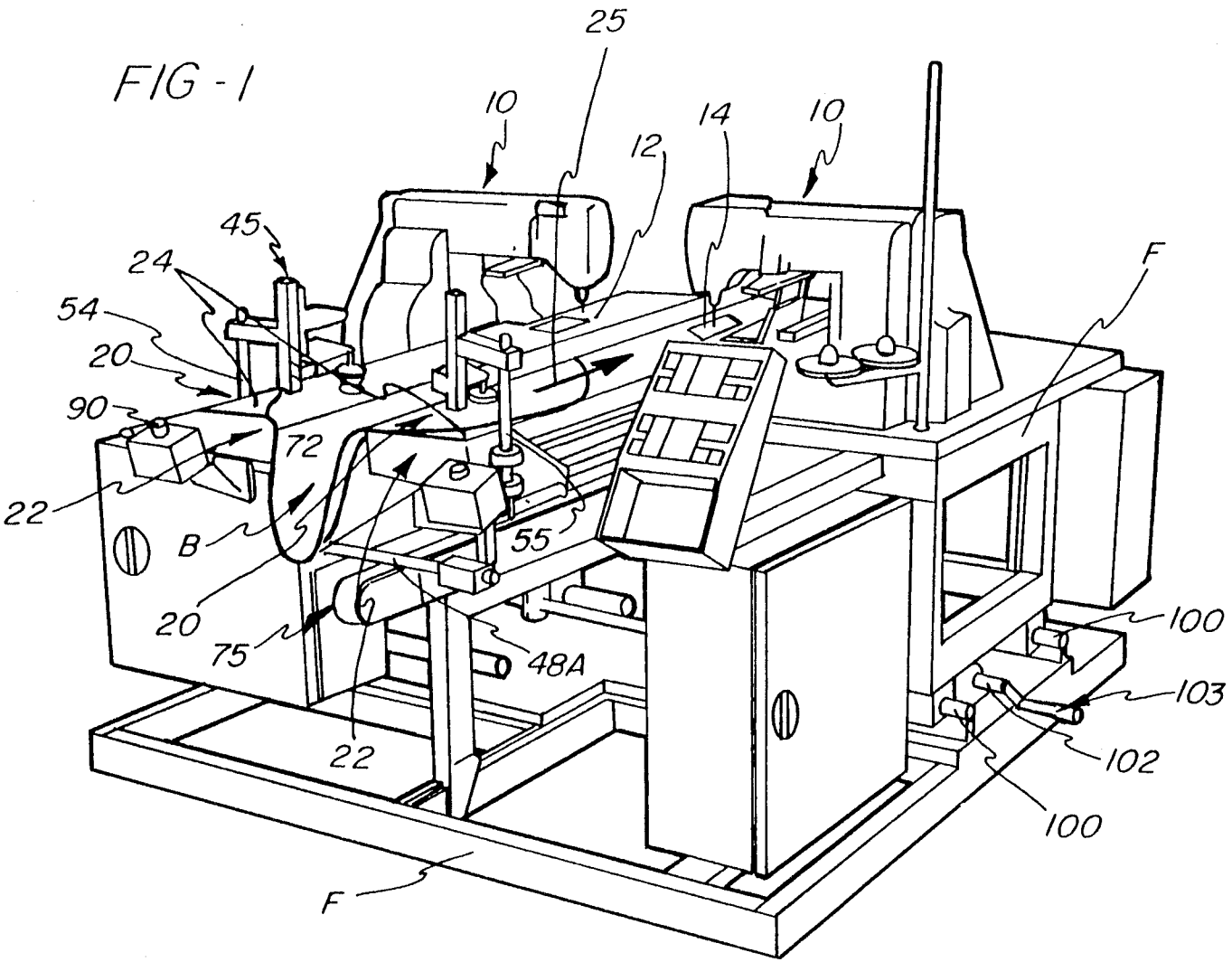
FIG. 1 is a perspective view showing the overall layout of a double sewing head and loading apparatus, whereby two reinforcements (or equivalent) can be attached to a sheet of fabric.
Figure 2:
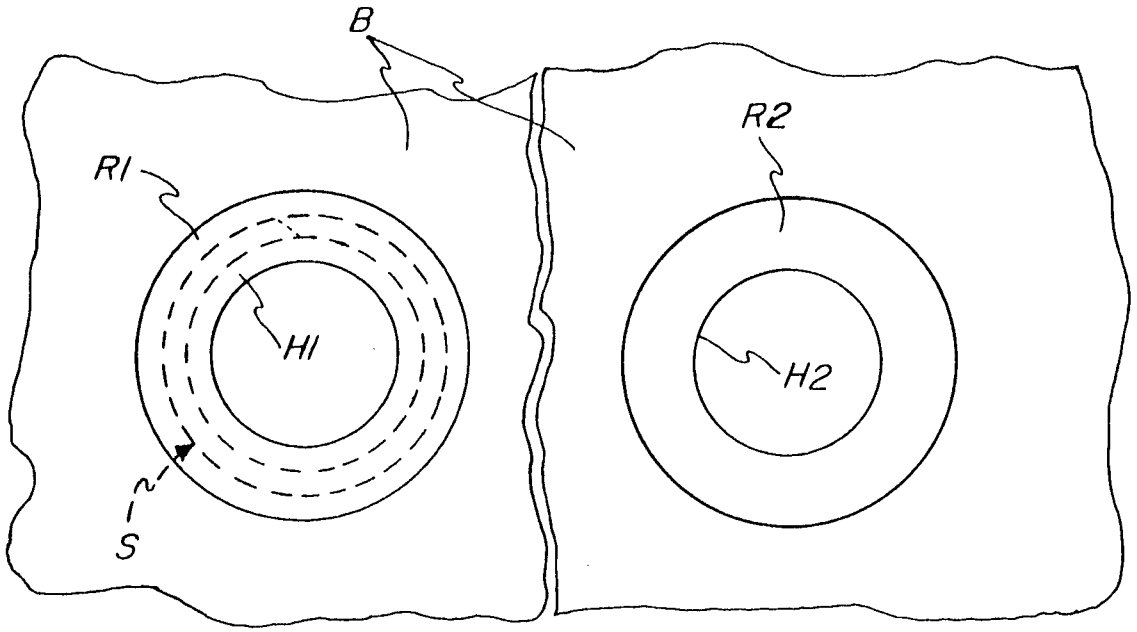
FIG. 2 is a plan view of portions of a sheet of fabric having a pair of holes therein, with a reinforcement ring placed on the right-side hole, and a comparable ring stitched to the left-side hole.

Referring to FIGS. 1 and 2, adjacent segments of a fabric sheet B are seen in FIG. 2, provided with holes H1 and H2 representing for example vent holes in a panel of an air bag. Located on the sheet B, aligned with such holes, are reinforcements R1 and R2, which may take the form of fabric rings having predetermined inner and outer diameters. Ring H1 is stitched at S to the sheet, surrounding hole H1 and defining a vent hole of predetermined area, through which gases from internally of a bag (incorporating the sheet B as a panel) can vent at a predetermined rate. This, as is known, provides a controlled rate of deflation of the deployed bag.

Figure 4:
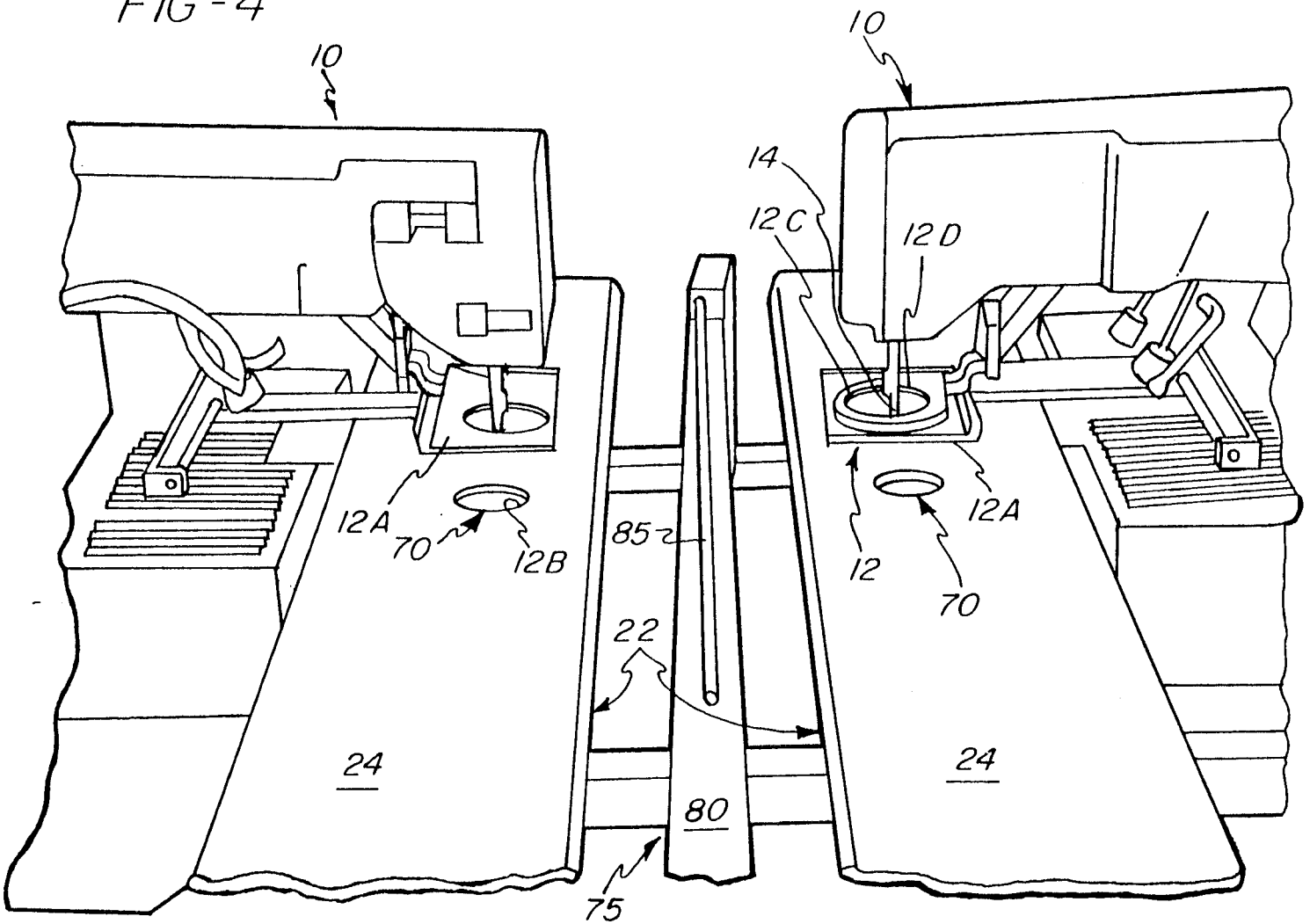
FIG. 4 is a perspective view looking along the tables and loading paths, toward the sewing heads.

FIG. 1 illustrates a two-unit embodiment of the invention. The supporting structure or frame of the apparatus is comprised of frame members designated by the general reference F. Each unit includes a programmable sewing head 10 having a maneuverable work clamping mechanism 12 (see also FIG. 4). That mechanism includes a lower movable plate 12A with an opening 12B which defines the boundaries of motion of the clamping mechanism. A movable upper ring 12C having an opening 12D somewhat greater than plate opening 12B, cooperates with plate 12A to clamp the material to be sewn between them; one of rings 12C is omitted from FIG. 4 to uncover and fully show one plate 12A. Thus it follows that opening 12D is greater in area than the holes H1, H2, and the air bag material is loaded, together with the reinforcement strategically placed thereon, into this opened clamping mechanism for automatic attachment (by a predetermined stitching pattern) of the reinforcement R to the bag material B. In known manner, the closed clamping mechanism is moved by instruction from the sewing head programmable logic controllers (PLC-2 and PLC-3), to guide the captured fabric and reinforcement past the reciprocating needle 14. The major function of such controllers, as is known, is to cause the clamping mechanism to maneuver the material within its grasp relative to the reciprocating needle 14, thereby to create a programmed pattern of stitches in the material. Reference is made to U.S. Pat. Nos. 4,870,917 and 4,763,587, both assigned to the assignee of this application, which disclose more detail of such clamping structures and the programmable X-Y actuators which perform repeatable logic controlled stitching.

Figure 3:
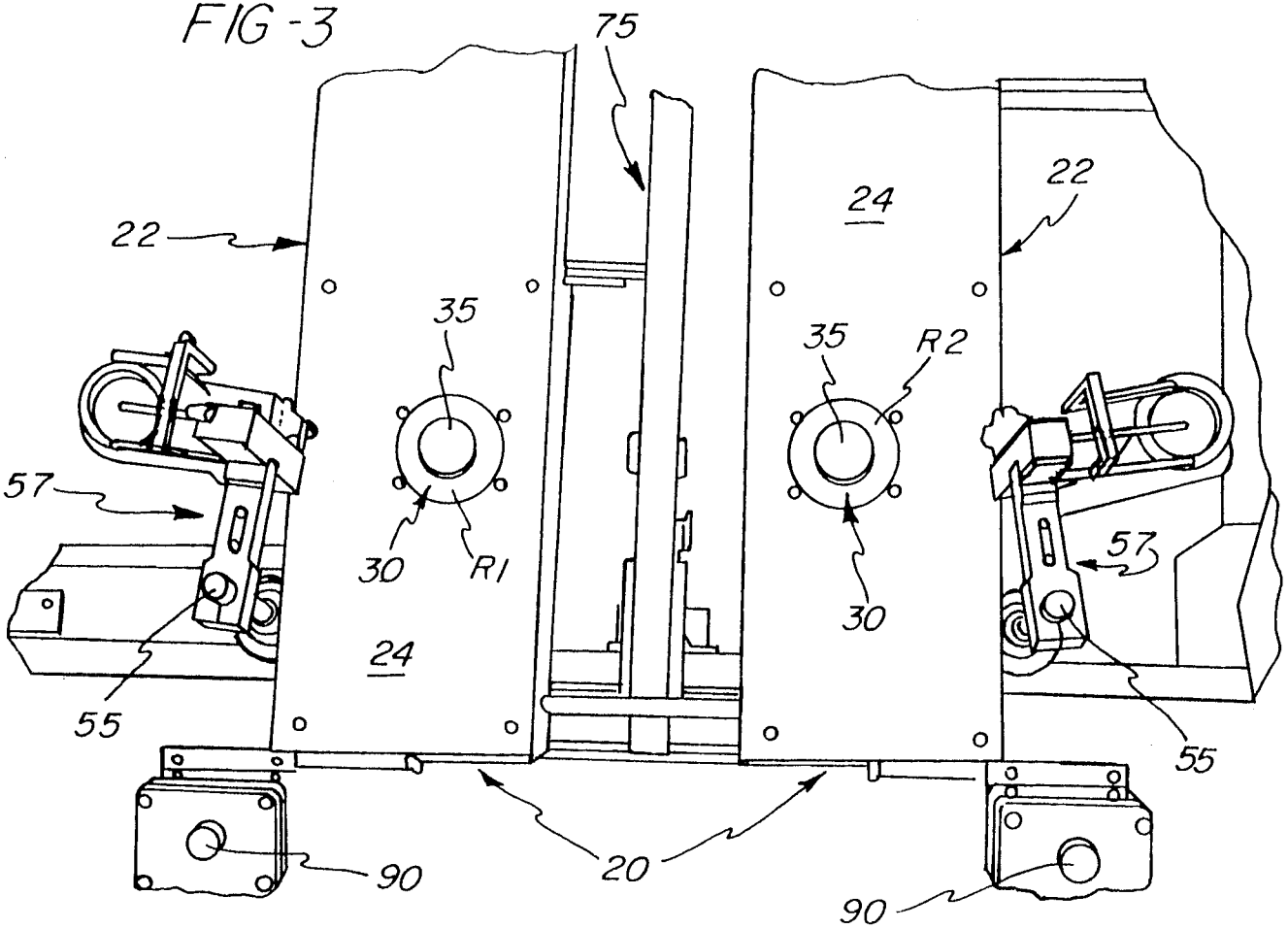
FIG. 3 is a perspective view from above the loading station of the apparatus, with reinforcement rings shown placed about the locating pads.

A loading station 20 is provided for supporting the bag material (usually a sheet of rubber coated nylon cloth) and orienting the aperture H therein which requires a reinforcement. The loading station includes a support table 22 for the flexible sheet, having a surface 24 extending beneath said sewing head and outwardly away therefrom defining also a predetermined loading path (indicated by arrow 25 (FIGS. 1, 3 and 5), along surface 24 to a transfer station at the clamping mechanism 12 of sewing head 10.

A locator aperture 30 (FIG. 3) is formed in table surface 24 at the loading station. Such locator aperture 30 preferably has a configuration corresponding to the aperture in the sheet. A locator device 33 (FIGS. 5 and 10) is mounted in locator aperture 30 and includes a retractable locator pad 35 normally positioned above surface 24 and retractable into said surface. Pad 35 is constructed to provide a locating reference for the sheet and reinforcement. Thus, in the illustrated example the locator pad 35 in its raised ready position is arranged to extend through aperture 30 and receive the aperture or vent hole H in the flexible sheet B, and the hole in the reinforcement R. This aligns the reinforcement with respect to the aperture in the sheet at the loading station 20. This can be accomplished simply by the operator placing the vent hole H in sheet B over locator pad 35, and doing the same with the reinforcement R either before or after placing the sheet in loading position; see FIGS. 3 and 6.

Figure 12:
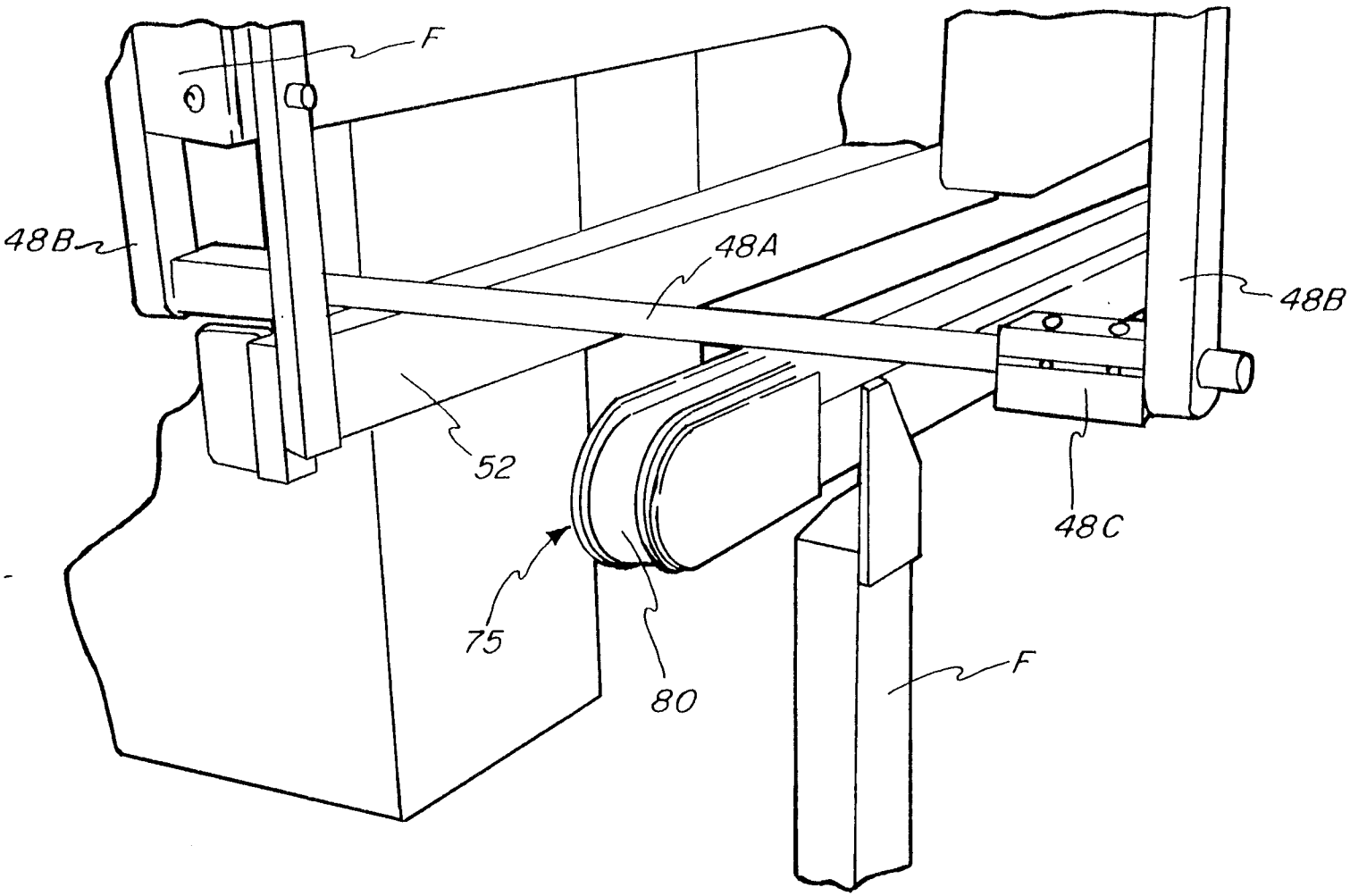
FIGS. 12 and 13 are perspective views of opposite ends of the discharge conveyor which is located below and between the facing edges of the two tables in FIG. 1.

A transfer pad 40, having a configuration such as to fit through the aligned apertures in a sheet and reinforcement, is supported by a transfer mechanism 45 for movement over and along table surface 24. This mechanism is mounted on a carriage 48 which runs along a track 50 extending beneath and parallel to table 20. Motion of the carriage 48 is controlled by a pneumatic cylinder 52 which can shuttle the carriage between the loading position (adjacent locator pad 30), the transfer position adjacent clamping mechanism 12, and an optional intermediate park or waiting position. For this purpose, cylinder 52 is of the so-called "rodless" type, having a free internal piston with an external drive bracket 53 (FIG. 5) attached to carriage 48 by an arm 54. A connecting rod 48A (FIGS. 5 and 12) extends between brackets 48B on the respective carriages 48, the connection 48C (FIG. 12) being adjustable to accommodate changes in spacing between the two units of the apparatus.

Figure 8:
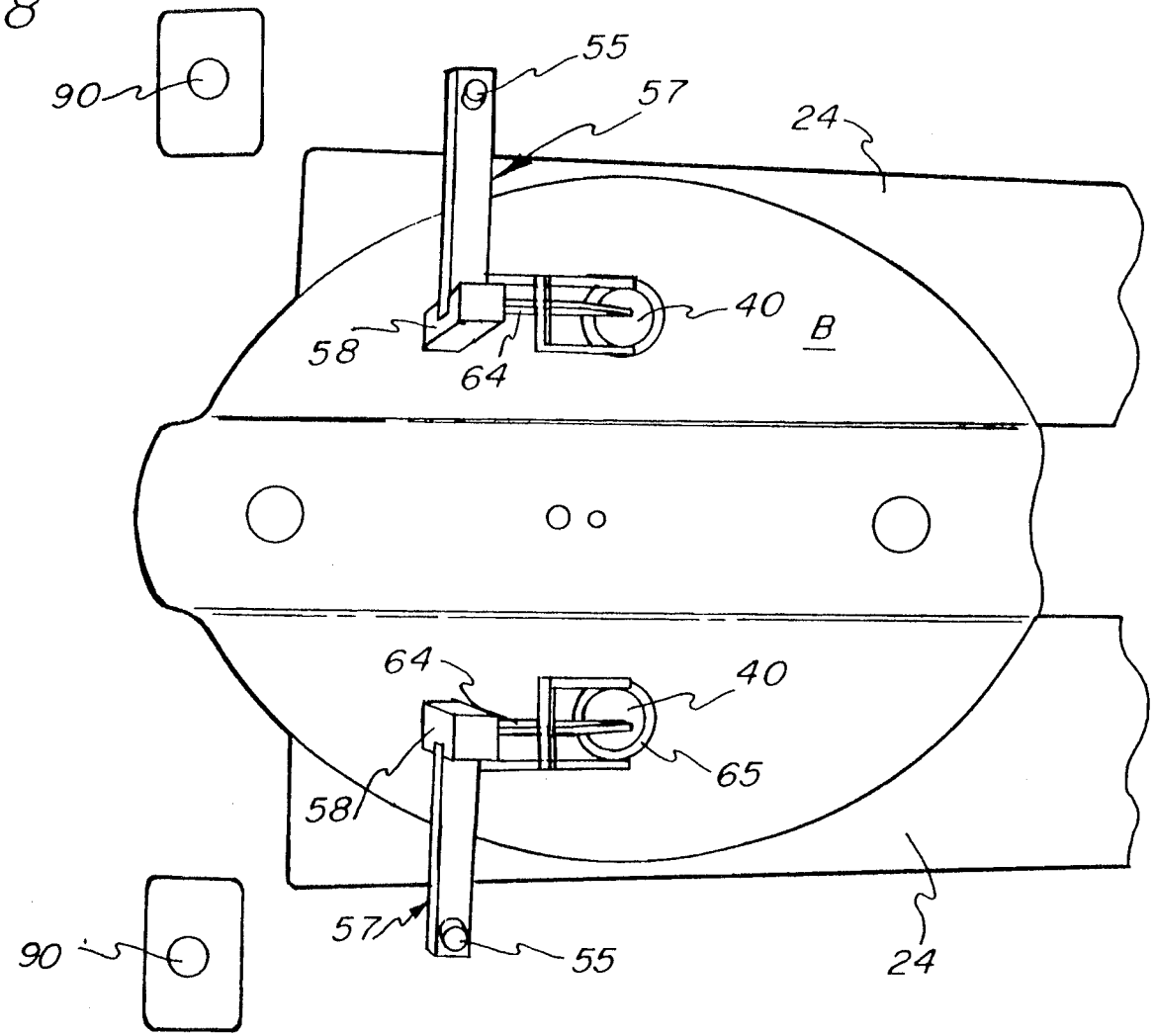
FIG. 8 is a plan view similar to FIG. 6, with the transfer mechanisms swung inward over the locating pads and above the sheet.

Each carriage 48 supports a vertical shaft 55 at its opposite ends, in bearings 56, for rotation from one side of table 20 (FIGS. 3, 5 and 6) to a position over locator aperture 30 (FIGS. 8 and 9), which position is defined by a stop arm 55A. The following description applies to both loading stations. Arms 57 are generally T-shaped, having a base fastened to and extending outward to one side of shaft 54, and having vertically disposed heads 58, each of which provides a mounting for two vertically arranged pneumatic cylinders 60 and 62. Cylinder 60 is pivoted to head 58 by a pin 61 at the top of cylinder 60, and is connected to an arm 64 at its lower end. Arm 64 is mounted for vertical sliding motion along head 58, thus actuation of cylinder 60 raises and lowers that arm, and transfer pad 40 which is suspended from the outer end of arm 64.

Thus, the transfer pad 40 is normally located at or near the loading station, and is capable of vertical alignment with locator pad 35. In the arrangement shown, the transfer mechanisms park (position not shown) to one side of the loading station, intermediate the loading and transfer stations. When a loading operation is initiated by an operator, the carriages are moved to the loading station (FIGS. 3 and 5), then the pivot controlling cylinders 63 of the transfer mechanisms 45 are actuated to move transfer pads 40 into vertical alignment with locator pads 35. The transfer pads 40 can then be moved along a vertical path extending through the corresponding locator pad 35, and through the aligned holes in sheet B and reinforcements R1 and R2, by actuating cylinders 60.

Figure 5:
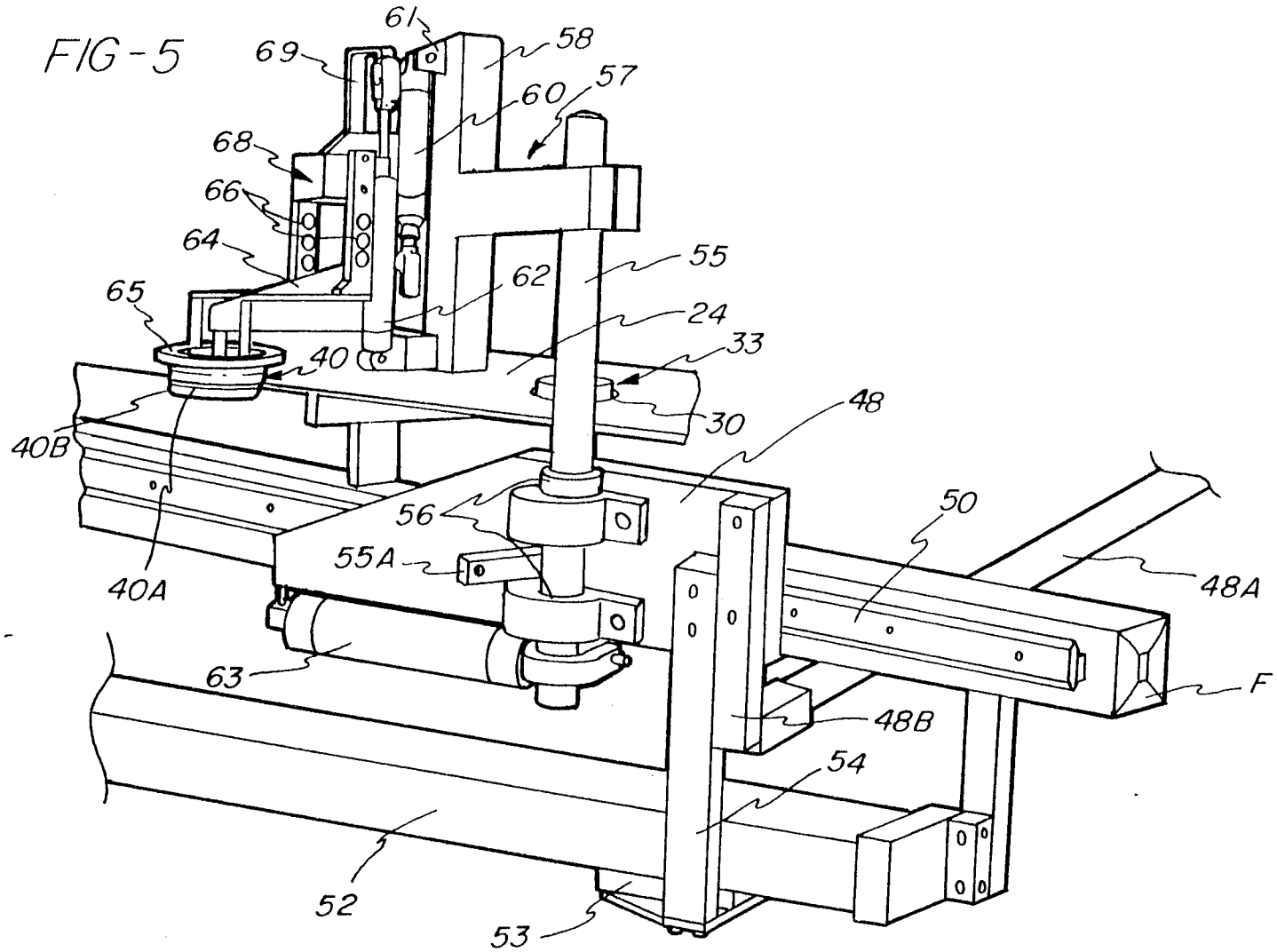
FIG. 5 is a view taken from one side of one transfer mechanism and its transfer pad, shown in its withdrawn or ready position.
Figure 6:
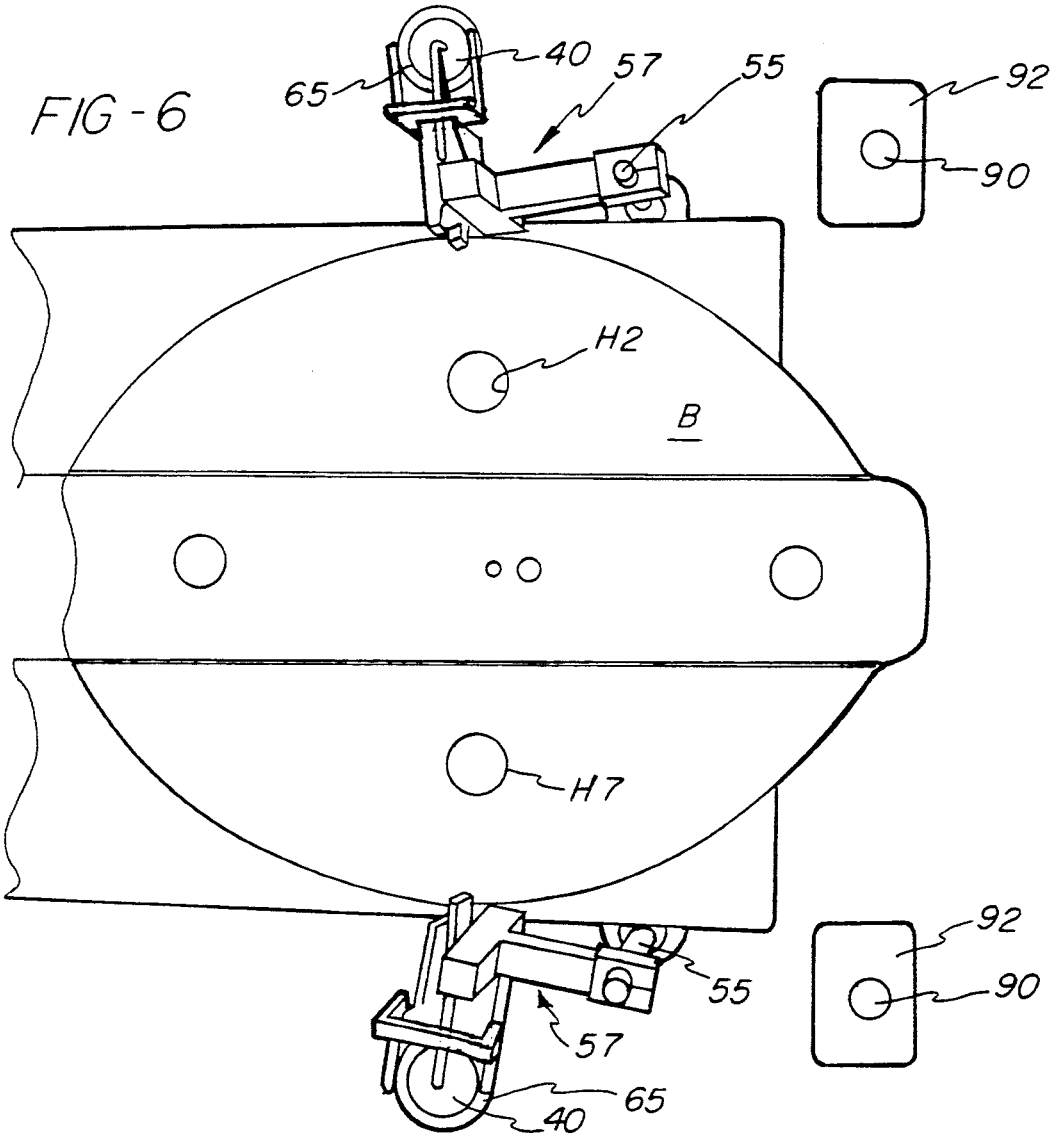
FIG. 6 is a plan view of the loading stations, illustrating a flexible sheet with two vent holes placed over the respective reinforcement pads and about the locating pads, with the center portion of the sheet draped between the two tables.
Figure 9:
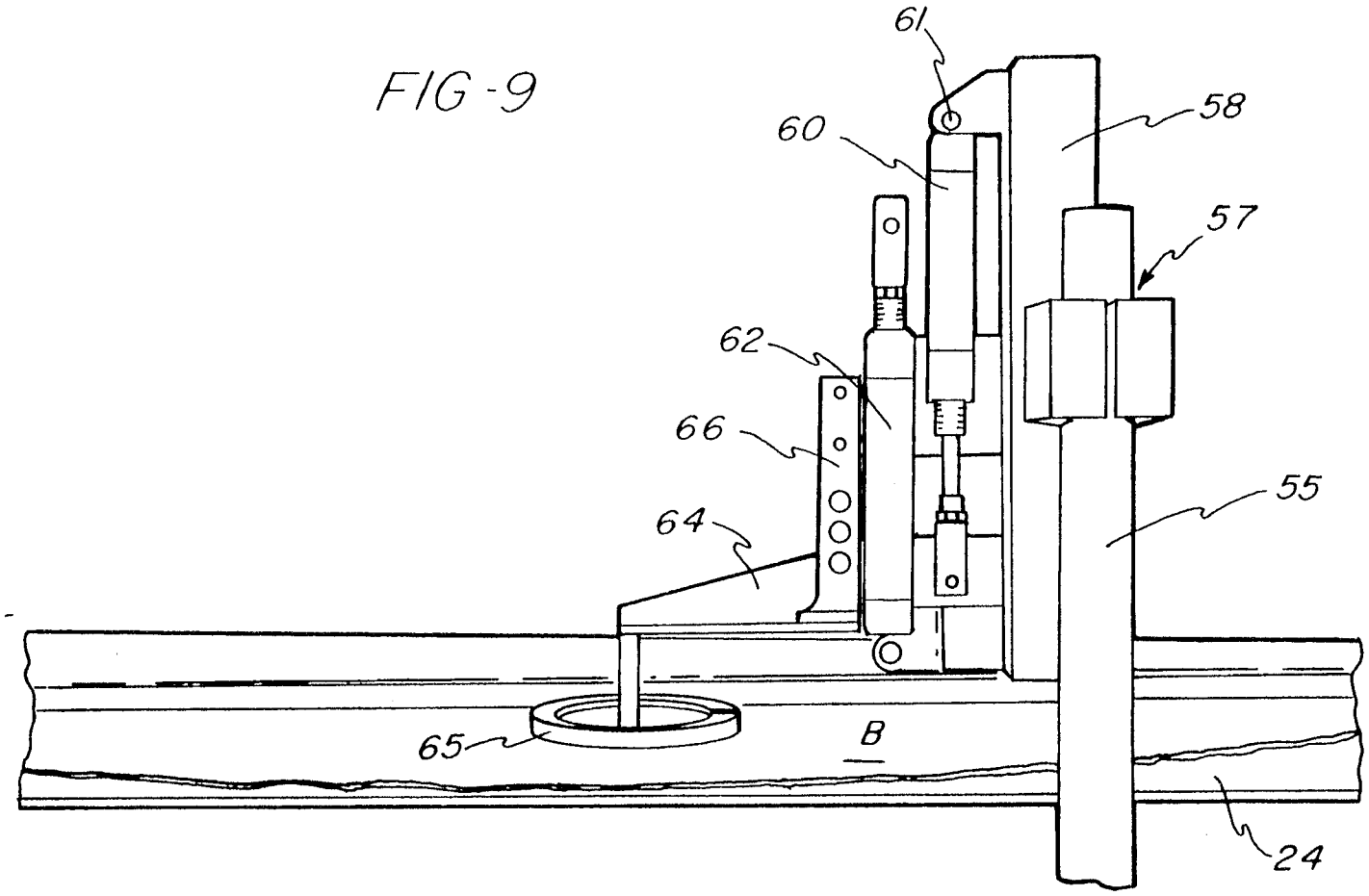
FIG. 9 is a view similar to FIG. 7, with the transfer pad entered into the hole in the sheet and into the reinforcement ring.
Figure 10:
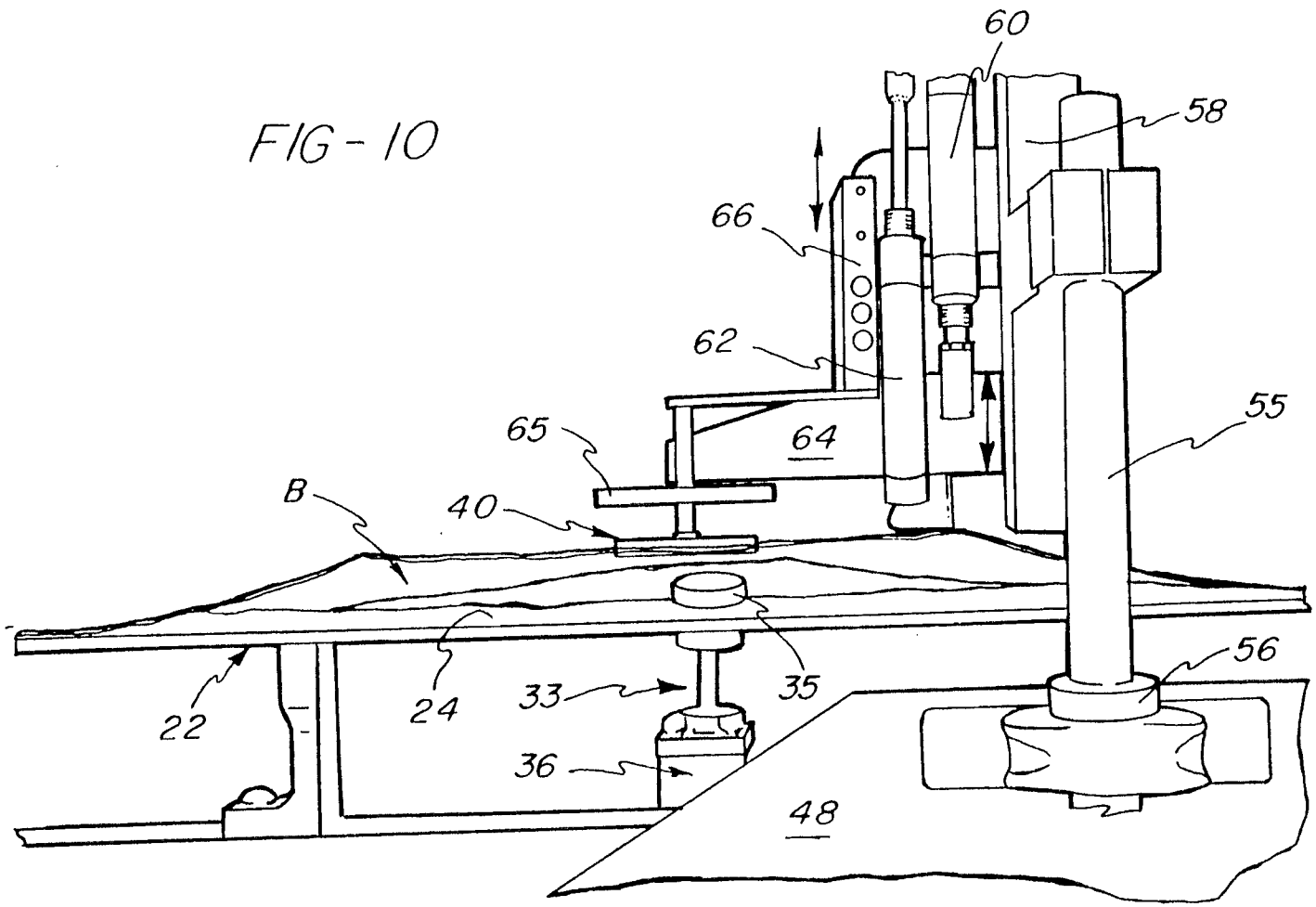
FIG. 10 is a further view similar to FIGS. 7 and 9, showing the transfer pad lifted above the table surface, carrying surrounding parts of the sheet, and the reinforcement ring, with the transfer pad.

A clamping ring 65 is associated with transfer pad 40, surrounding it as shown in FIGS. 5, 9 and 10, and is adapted to hold the portion of the flexible sheet (and the reinforcement ring) surrounding the aperture in the sheet, against table surface 24 while pilot portion 40B enters the aligned aperture and annular reinforcement at the loading station. For this purpose, clamping ring 65 is suspended from a pair of spaced apart L-shaped arms 66 which are joined to form a vertically movable holder 68. That holder is guided for vertical motion on head 58, and one arm 66 has a bracket 69 attached to the rod end of cylinder 62. Thus ring 65 is separately movable from transfer pad 35, and can descend to clamp the sheet and reinforcement against the surrounding table surface before the transfer pad is actuated, and the ring can be retracted around and above the transfer pad (see FIG. 10) as that pad is raised, bringing the surrounding regions of the sheet, and the reinforcement ring, with it.

Figure 7:
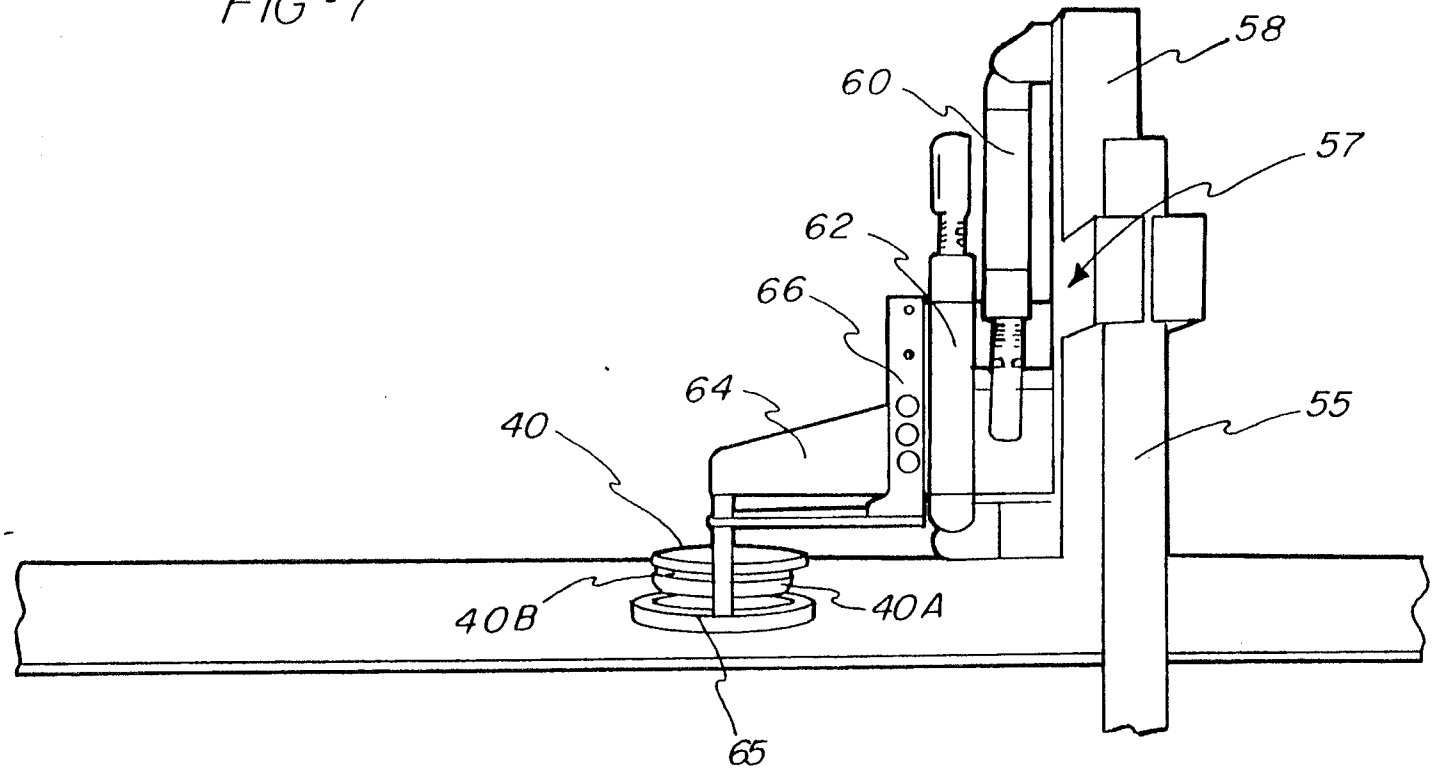
FIG. 7 is a side view of one transfer mechanism with the transfer pad clamp engaged upon the sheet, and the transfer pad still elevated.

Each transfer pad 40 has a pilot portion 40A (FIGS. 5 and 7) constructed to be force fit through a reinforcement and the related aperture in a flexible sheet, aligned on locator pad 35, and to displace the locator pad from the sheet and the reinforcement aligned on it, pushing the locator pad 35 to a retracted position within the locator aperture. The locator mechanism includes a pneumatic cylinder 36 (FIG. 10) which supports pad 35, and which is spring loaded to the upper or ready position of locator pad 35. When that pad has been pushed into the aperture 30, cylinder 36 is pressurized to hold locator 35 in retracted position until the sheet has been moved from the loading station.

The pilot portion 40A includes a peripheral groove 40B dimensioned to engage with and retain the aligned flexible sheet and reinforcement, by a forced fit through the holes. As a result of this displacing motion of the transfer pad 40, it takes over control of the sheet and the reinforcement, holding the parts in alignment.

Then, movement of transfer pad 40 along the loading path carries those parts into position for transfer into the clamping mechanism of the sewing head. The transfer station is defined in part by a transfer aperture 70 in table surface 24, adjacent to sewing heads 10 and within the range of motion of their clamping mechanisms 12. A support trough 72 is provided between tables 22 to support the central part of sheet B (if needed) at the loading stations 20, and to facilitate the sliding motion of sheet B, as necessary. It will be appreciated this trough, or an equivalent support device, is optional depending on the application of the apparatus, and whether it is a single or double unit apparatus. Trough 72 ends before the transfer station, thus the central part of sheet B is suspended from the parts under control of the two clamping mechanisms 12, once transfer is completed.

Figure 11:
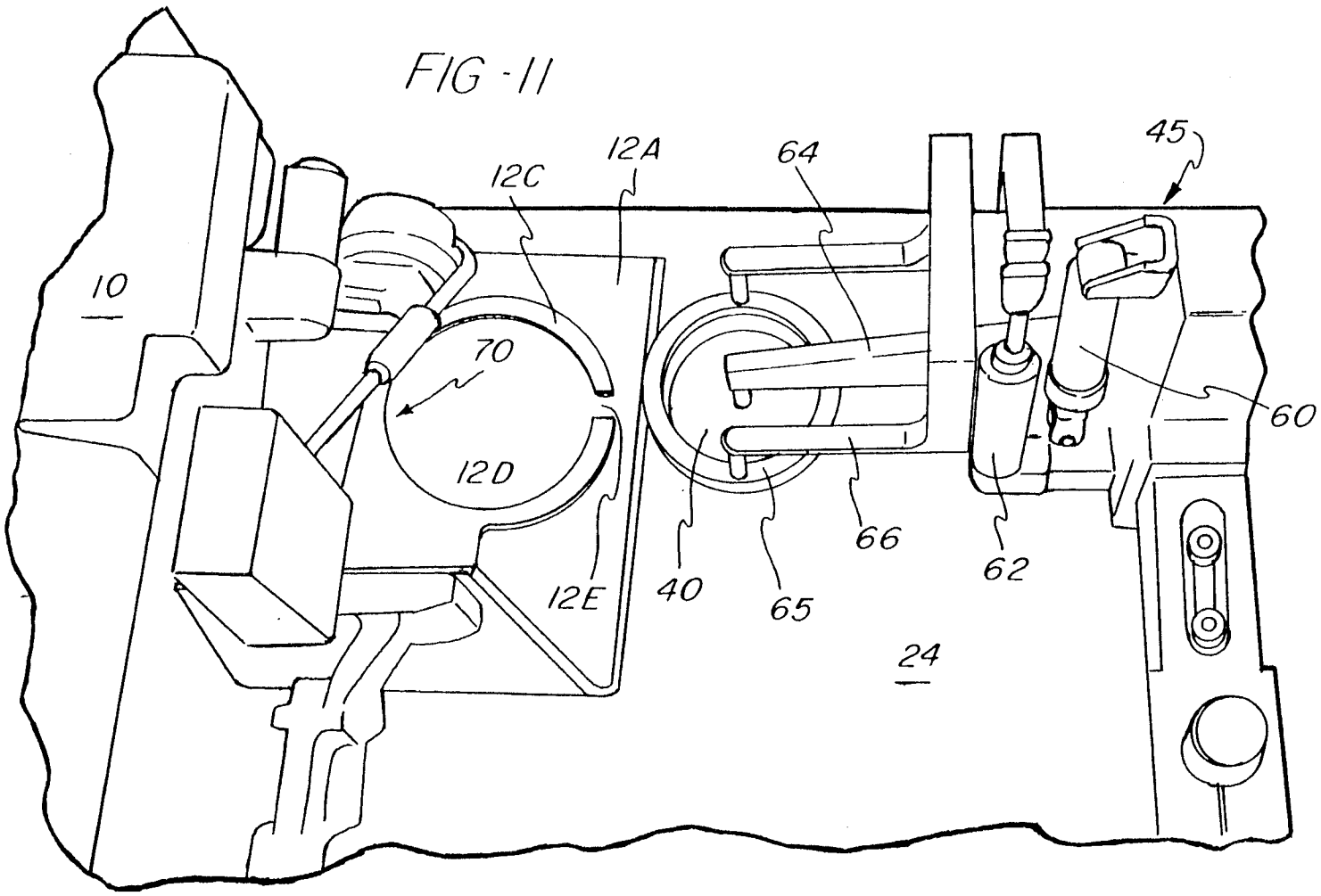
FIG. 11 is a view from the top of the transfer mechanism carrying the sheet and ring, approaching the clamp ring of the sewing head.

The sheet and reinforcement are transferred into clamping mechanism 12, all the while maintaining alignment of sheet B and reinforcement R. The aperture 12B in plate 12A is centered over transfer aperture 70, and the transfer mechanism enters the clamping mechanism 12 through the opening 12E in ring 12C, as shown in FIG. 11, until transfer pad 40 is centered with respect to aperture 70.

Clamping ring 65 descends into the aperture in plate 12A and ring 12C, and holds the sheet and reinforcement against the table surface surrounding aperture 70. Transfer pad 40 then is withdrawn from the sheet and reinforcement, and the transfer mechanisms 45 return to the ready or park position, while the sewing heads proceed to stitch together the parts loaded therein. When the stitching operation is completed, the now combined sheet B and reinforcements R1, R2 are released by the clamping mechanisms 12, and removed for inspection and further processing. In the meantime, an operator can be loading another sheet and reinforcements at loading stations 20.

Figure 13:
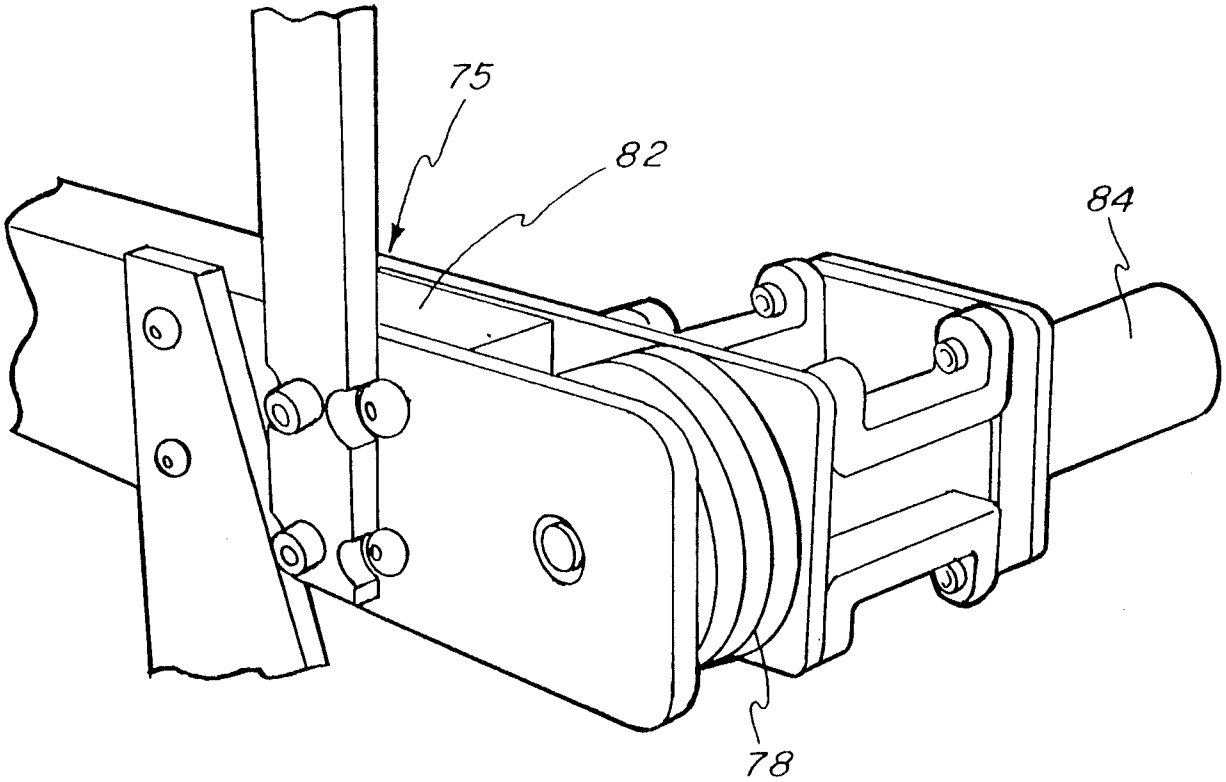
Figure 14:
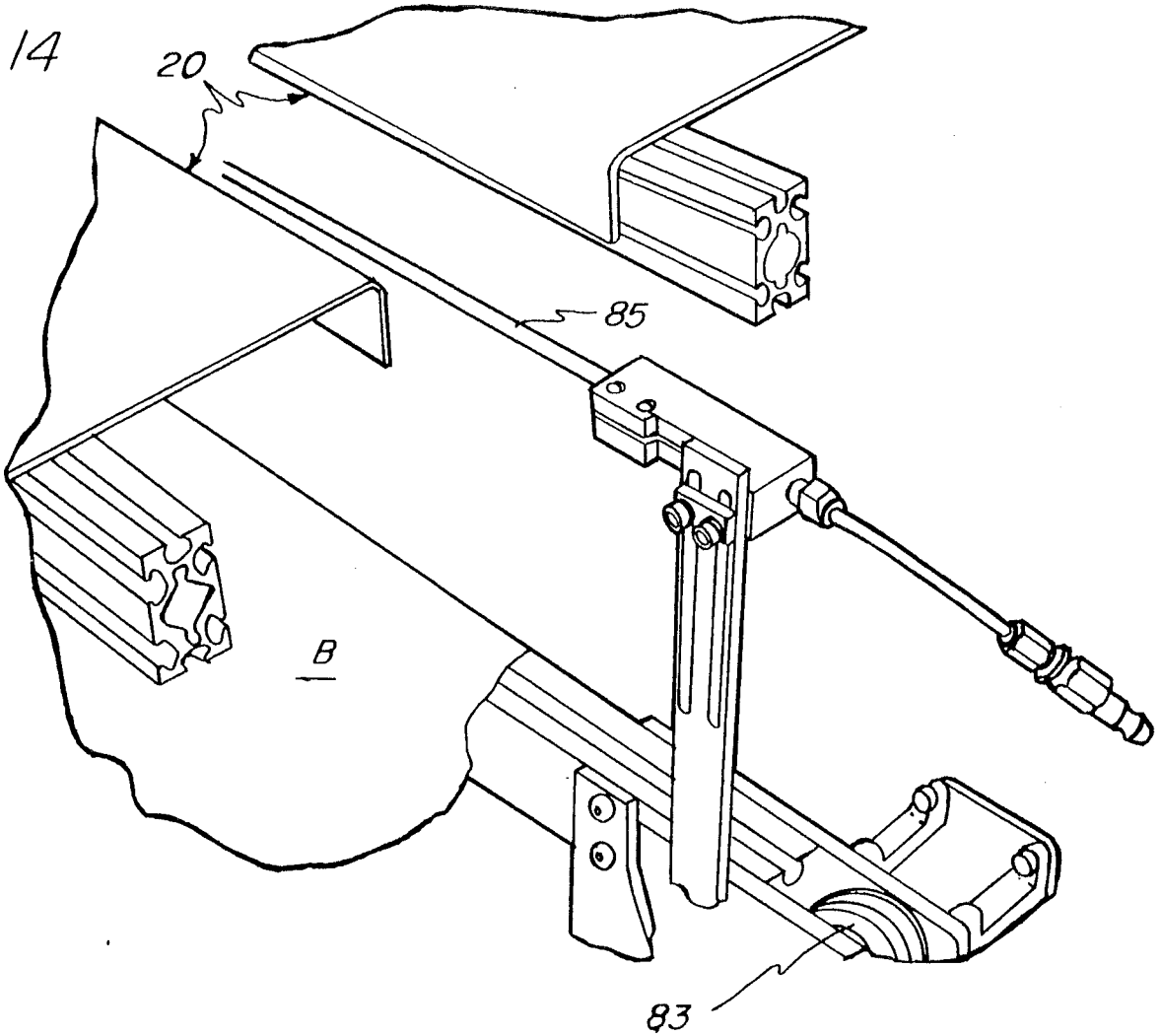
FIG. 14 is a perspective from above the transfer ends of the apparatus, with the sewing heads omitted for clarity, showing an optional air nozzle for promoting motion of a sheet released from the sewing head clamps into the space between the tables and onto the discharge conveyor.

In the space between tables 22, there is an optional discharge conveyor 75 (FIGS. 1, 3, 4, 12 and 13) which is supported from frame F. The conveyor includes an idler pulley (not shown) near the loading station 20, and a driven pulley 78 adjacent and below the sewing heads 10. A conveying belt 80 is passed about and driven by this pulley system, and a bar 82 extending generally between the pulleys provides support for the upper (conveying) flight of belt 80. A motor 84 (FIG. 13), controlled by controller PLC-1, drives pulley 78. Directly over the upper flight of belt 80 (FIGS. 4 and 14), in position to enter the hanging "loop" in the sheet as it is moved into the transfer location, is an optional air pipe 85 which may be pressurized from the pneumatic system and emit small stream of air through holes (not shown) in pipe 85 to urge heavier sheets (if that is needed) to drop onto the conveyor.

The two unit apparatus disclosed includes a provision for adjustment of spacing between the tables 22 and associated sewing heads, so as to accommodate sheets of considerably different size, beyond the capacity of the loop or fold which can enter support trough 72. For that purpose, the unit shown on the right (FIG. 1) is supported on rods 100 and is under the control of a leadscrew 102 operated by crank 103. Block 48C, which connects the carriage of that unit to the cross-rod 48A, can be loosed during such adjustment and again tightened, to accommodate the change in spacing.

The sewing heads have their own programmable controllers PLC-2 and PLC-3, which as mentioned control the operation of each head's stitching mechanism and the X-Y motion of its clamping mechanism, so as to complete the desired stitching pattern. The control means for moving the transfer pads 40, first to engage with a sheet and reinforcement at said loading station, then to raise the surrounding portion of the sheet and the reinforcement above the table surface (FIG. 10) and move those parts into the clamping mechanisms 12, is provided by a further programmable controller PLC-1, interacting with the controllers for the sewing heads, to coordinate movements of the loading mechanism with the sewing head mechanisms, and also controlling the various cylinders previously mentioned in a programmed manner.

Figure 15:
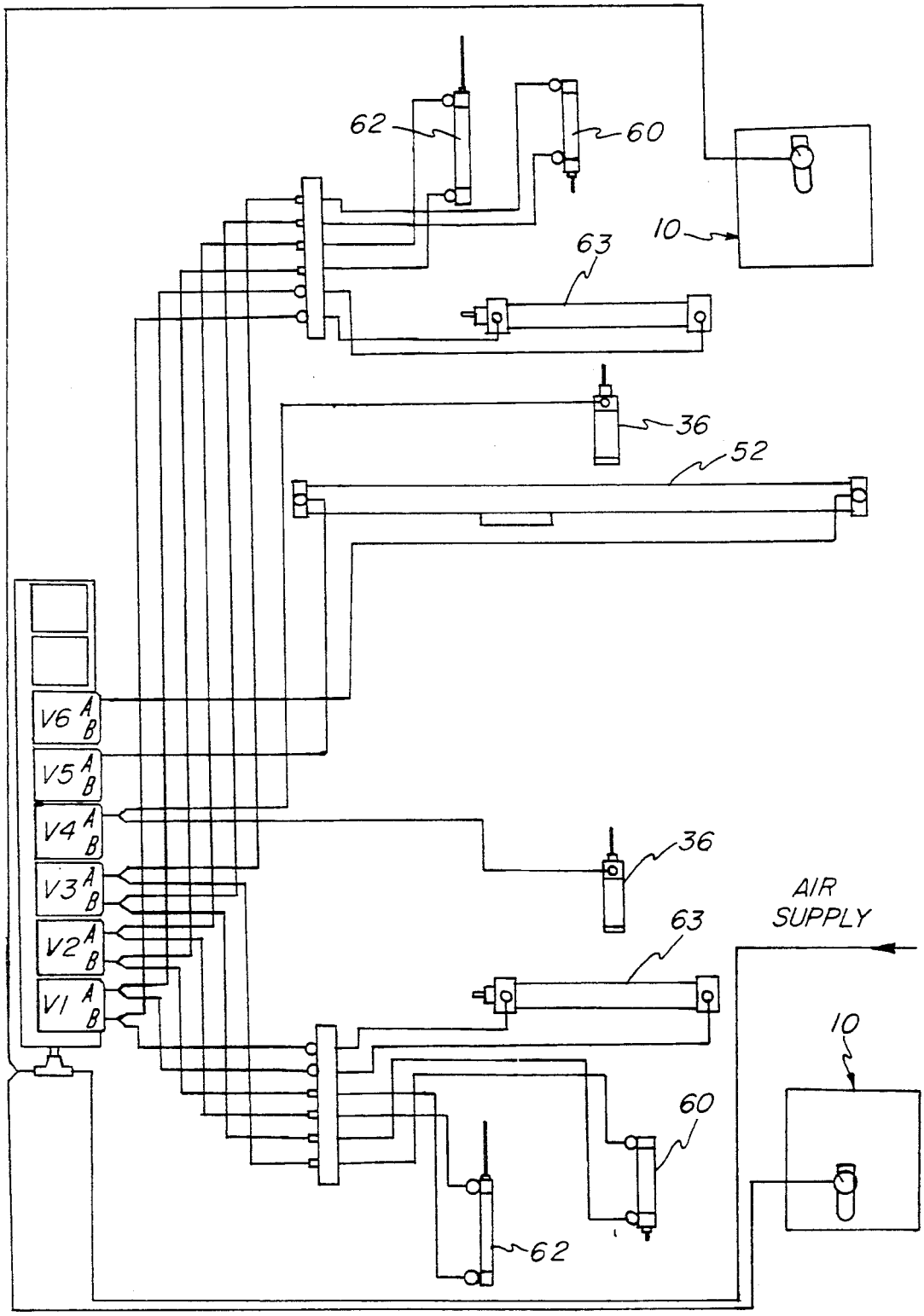
FIG. 15 is a pneumatic diagram showing the several actuating cylinders of the apparatus and their control.
Figure 16:
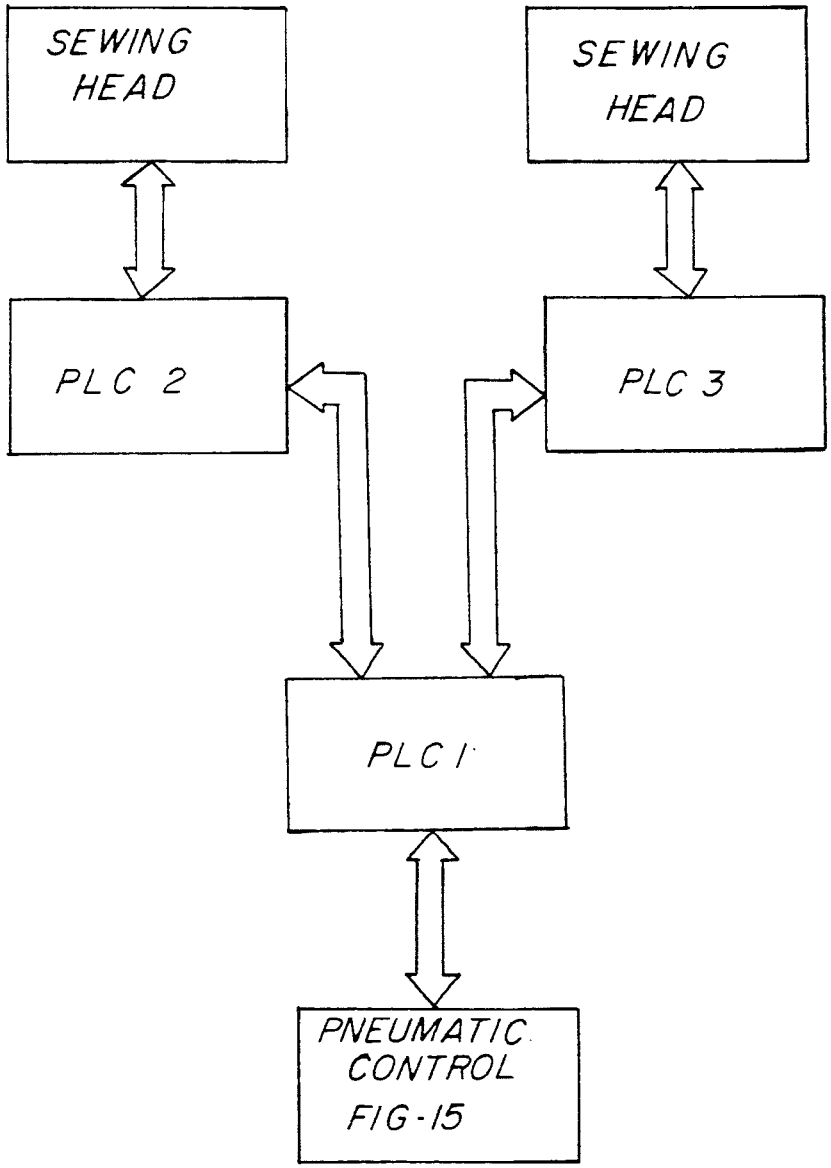
FIG. 16 is a block diagram showing the relationship of the several programmable controllers for the sewing heads and the loading apparatus.

FIG. 15 is a diagram showing the pneumatic control circuit for supplying air under pressure to the various actuating cylinders of the system. The blocks labelled V1–V6 are conventional electrically controlled pneumatic valves; the two blocks not labelled represent spare vales in a commercially available unit. The actuation of the individual valves is under control of programmable logic controller PLC-1 (see FIG. 16). A typical loading operation proceeds as follows.

At the loading station 20, a sheet B and reinforcement H are loaded in aligned position on locating pad 30. If the two-unit apparatus is employed, opposite holes in a sheet are separately placed on the two locating pads with separate reinforcements. At this point transfer mechanisms 45 are parked an swung outward. The operator presses both start buttons 90 on spaced apart control boxes 92; this is a typical two-hand control which assured the operators hands are away from the moving parts. Pressing both buttons 90 initiates an operating cycle, starting first the program of PLC-1, which in turns controls the sequence of operation of valves V1–V6 to direct air under pressure to the various cylinders.

Mechanisms 45 move to the loading station 20, swing inward, and lower first clamp rings 65, then transfer pads 40. Once the sheet and reinforcements are engaged with transfer pads 40, these are raised, the clamps released, and cylinder is actuated to move mechanisms 45 to the transfer station, where the clamping mechanism 12 are waiting, opened. The transfer pads enter into the center of clamp rings 12C, then clamp rings 12C and clamp rings 65 descend to hold the reinforcement R and the adjacent area of sheet B while transfer pads 40 are withdrawn. Once the transfer mechanisms are cleared of the head's clamping mechanisms 12, a signal is sent to PLC-2 and PLC-3 to proceed with stitching, and the head stitching program is executed while the transfer devices return and park, and the operator loads the next sheet and reinforcement at the loading station. A pressure sensing switch (not shown) in the pneumatic circuit will sense low (or no) pneumatic pressure, and inhibit operation of the controllers.

When the stitching program(s) are completed, the head's clamping mechanisms 12 release, and sheet B drops onto conveyor belt 80. Conveyor motor 84 is energized to carry the sheet away, as to an inspection station. In one actual embodiment, the sheet is carried forward to the operator at the loading station position, and that operator removes the sheet, visually inspects the sewn reinforcements, and places the sheet for removal to subsequent bag making operations.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. Apparatus for attaching a reinforcement to a flexible sheet, comprising a sewing head including a clamping mechanism having an upper ring with an opening therein of predetermined area, a support table for the flexible sheet including a surface extending beneath said sewing head and outwardly away therefrom defining a loading station and a predetermined loading path along said surface to a transfer station at said clamping mechanism, a locator at said loading station, said locator having a configuration to which the reinforcement and a predetermined part of the sheet may be aligned, said locator being adapted to provide alignment of the reinforcement with respect to the predetermined part of the sheet at said loading station, a transfer pad having a configuration corresponding to said locator, means supporting said transfer pad for movement along a vertical path extending through said locator and for movement along said loading path to said sewing head, control means for moving said transfer pad first to engage with a sheet and an aligned reinforcement at said loading station, then to raise the surrounding portion of the sheet and the reinforcement above said table surface, and then to move the transfer pad into alignment with said clamping mechanism, whereby the aperture in the sheet and the aligned reinforcement can be loaded automatically into said sewing head for subsequent stitching of said reinforcement to the flexible sheet in precise alignment with the aperture in the sheet.

2. Apparatus as defined in claim 1, including a clamping ring associated with said transfer pad and adapted to hold a portion of the flexible sheet and the reinforcement against said table while said transfer pad engages the aligned sheet and reinforcement.

3. Apparatus as defined in claim 1, wherein said control means for moving said transfer pad includes a track extending along said transfer path, a carriage movable along said track and motor means for reciprocating said carriage on said track between said loading station and said transfer station, means for supporting said transfer pad on said carriage in a normally retracted position above said table surface and for moving said transfer pad toward and away from said table surface at said loading station and at said transfer station.

4. Apparatus as defined in claim 1, further including a support trough formed along said table surface spaced from and parallel to said transfer path to hold portions of the flexible sheet during a loading and transfer operation.

5. Apparatus as defined in claim 4, further including conveyor means mounted below said trough and positioned to receive a flexible sheet from said sewing head after stitching of said reinforcement to the sheet, whereby release of said clamping mechanism will allow the sheet to descend to said conveyor means, and a control for said conveyor means for driving said conveyor means to discharge a sheet with attached reinforcement from the apparatus.

6. Apparatus as defined in claim 1, further comprising said means supporting said transfer pad including a carriage and a track supporting said carriage for shuttling motion between said loading station and said transfer station, a head supported on said carriage and carrying said transfer pad, bearing means supporting said head for pivoting motion about a vertical axis and means for swinging said head with respect to said carriage, a slide supporting said transfer pad on said head for vertical motion toward and away from said table surface and means for moving said slide, whereby said transfer pad is movable toward and away, and along, said table surface.

7. Apparatus as defined in claim 1, wherein said control means includes a programmable controller constructed and arranged to govern the motions of said transfer pad.

8. Apparatus as defined in claim 1, wherein said locator includes a retractable locator pad normally positioned above said table surface at said loading station and retractable into said surface, said locator pad being configured to receive and orient a portion of the sheet to which the reinforcement is to be attached, and to receive and orient such reinforcement.

9. Apparatus for attaching an annular reinforcement about the periphery of an aperture in a flexible sheet, comprising a sewing head including a clamping mechanism having an upper ring with an opening greater than the aperture, a support table for the flexible sheet including a surface extending beneath said sewing head and outwardly away therefrom defining a loading station and a predetermined loading path along said surface to a transfer station at said clamping mechanism, a locator aperture in said surface at said loading station, said locator aperture having a configuration corresponding to the aperture in the sheet, a locator mounted in said locator aperture and having a retractable locator pad normally positioned above said surface and retractable into said surface, said locator pad being adapted to extend through the aperture in the sheet and in the reinforcement for aligning the reinforcement with respect to the aperture in the sheet at said loading station, a transfer pad having a configuration corresponding to said locator pad so as to fit through the aperture in a sheet and through a reinforcement aligned therewith, means supporting said transfer pad for movement along a vertical path extending through said locator pad and for movement along said loading path to said sewing head, said transfer pad having a pilot portion constructed to be force fit through a reinforcement and the related aperture in a flexible sheet aligned on said locator pad and to displace said locator pad beneath said table surface, said pilot portion including a peripheral groove dimensioned to engage with the aligned flexible sheet and reinforcement, control means for moving said transfer pad first to engage with a sheet and reinforcement at said loading station, then to raise the surrounding portion of the sheet and the reinforcement above said table surface, and then to move the transfer pad into alignment with said clamping mechanism, whereby the aperture in the sheet and the aligned reinforcement can be loaded automatically into said sewing head for subsequent stitching of said reinforcement to the flexible sheet in precise alignment with the aperture in the sheet.

10. A method of orienting and joining a reinforcement to a flexible sheet, comprising the steps of (a) locating a portion of the sheet and the reinforcement at a loading station on a supporting table surface and orienting the reinforcement and sheet into predetermined, contacting positions, (b) clamping the sheet and reinforcement at the loading station, (c) temporarily fixing a transfer pad to the contacting parts of the sheet and reinforcement and releasing the clamping thereof, (d) moving the transfer pad along the table surface to a transfer station, (e) inserting the transfer pad with the retained portion of the sheet and the reinforcement into a clamping mechanism of a sewing head, (f) engaging the clamping mechanism and then releasing and withdrawing the transfer pad to give control of the reinforcement and surrounding region of the sheet to such clamping mechanism, and (g) operating the sewing head while moving its clamping mechanism to form a predetermined pattern of stitching which joins the reinforcement to the sheet.

* * * * *